US005102318A

United States Patent [19]

Yen

[11] Patent Number: 5,102,318

[45] Date of Patent: Apr. 7, 1992

[54] COMPRESSSOR STRUCTURE WITH ABUTMENT GUIDE BLOCKS

[76] Inventor: Chin-Fa Yen, No. 166, Nan Ning Rd., Tung Ning Tsun, Nei Pu Hsiang, Ping Tung Hsien, Taiwan

[21] Appl. No.: 618,851

[22] Filed: Nov. 28, 1990

[51] Int. Cl.[5] ..... F04C 18/332

[52] U.S. Cl. ..... 418/245; 418/247

[58] Field of Search ..... 418/245, 246, 247, 104, 418/235, 243, 244, 248, 249, 250

[56] References Cited

U.S. PATENT DOCUMENTS

| | | | |
|---|---|---|---|
| 154,298 | 8/1874 | Teal | 418/247 |
| 1,061,107 | 5/1913 | Nordmark | 418/247 |
| 1,261,128 | 4/1918 | Higgins | 418/245 |

FOREIGN PATENT DOCUMENTS

| | | | |
|---|---|---|---|
| 197943 | 1/1939 | Switzerland | 418/247 |
| 216222 | 11/1941 | Switzerland | 418/247 |
| 381886 | 10/1932 | United Kingdom | 418/247 |
| 383538 | 11/1932 | United Kingdom | 418/247 |
| 424555 | 2/1935 | United Kingdom | 418/247 |

*Primary Examiner*—Richard A. Bertsch
*Assistant Examiner*—David L. Cavanaugh
*Attorney, Agent, or Firm*—Varndell Legal Group

[57] ABSTRACT

The eccentric wheel, which is driven to rotate in the housing of a compressor, having two eccentric axles longitudinally aligned at two opposite ends for mounting a pair of links to hold a blocking plate. The blocking plate is carried by the links to displace when it is constantly disposed in contact with the eccentric wheel, and therefore, friction between the blocking plate and the eccentric wheel is greatly improved.

1 Claim, 4 Drawing Sheets

COMPRESSSOR STRUCTURE WITH ABUTMENT GUIDE BLOCKS

BACKGROUND OF THE INVENTION

The present invention relates to compressors, and more particularly to a compressor which can efficiently eliminate friction problem to greatly improve operational efficiency.

Various types of compressors have been disclosed for compressing air by revolving an eccentric wheel in a cylinder. During rotation of an eccentric wheel in a cylinder, a blocking plate which blocks in the cylinder chamber is simultaneously directly pushed by an eccentric wheel to displace. Because of friction problem between eccentric wheel and blocking plate, the revolving speed of a compressor is affected.

FIG. 1 illustrates a type of compressor in which a blocking plate is squeezed by a spring to constantly press against an eccentric wheel. During rotation of the eccentric wheel, the horizontally distributed force which results from pressure angle between the eccentric wheel and the blocking plate causes the eccentric wheel to severely rub against the bottom edge of the blocking plate. This friction problem may damage the mechanical parts of the compressor easily and greatly affect the performance of the compressor. Further, the performance of the spring which is used to push the blocking plate against the eccentric wheel may be deteriorated easily due to quick material fatigue problem, and the service life of the compressor may be shortened. In FIG. 2, there is illustrated another type of compressor. In this structure, a multi-blade blocking plate is adhered to the inner wall of the cylinder through centrifugal effect. This structure improves the revolving speed of the compressor. However, friction is simultaneously increased when centrifugal force is increased. Therefore, pressure angle problem still can not be eliminated, and air displacement can not be greatly increased. There is still another type of compressor, as shown in FIG. 3, which utilizes a blocking plate matching with two eccentric wheels in two cylinders. In this structure, pressure angle problem happens between the blocking plate and the two eccentric wheels, i.e., friction problem has not been improved.

SUMMARY OF THE INVENTION

The present invention has been accomplished under the circumstances in view. It is therefore the main object of the present invention to provide a compressor which can efficiently eliminate friction problem and provide high operational efficiency. Because the blocking plate is not directly pushed to move by the eccentric wheel in the preferred embodiment of the present invention, friction between the eccentric wheel and the blocking plate is greatly reduced. The blocking plate is flexibly mounted on two eccentric axles at two opposite ends of the eccentric wheel by a pair of links. During rotary motion of the eccentric wheel, the blocking plate is simultaneously carried by the links to displace up and down, and therefore, friction between the blocking plate and the eccentric wheel is improved.

DETAILED DESCRIPTION OF THE PREFERRED EMBODIMENT

Figure 3:
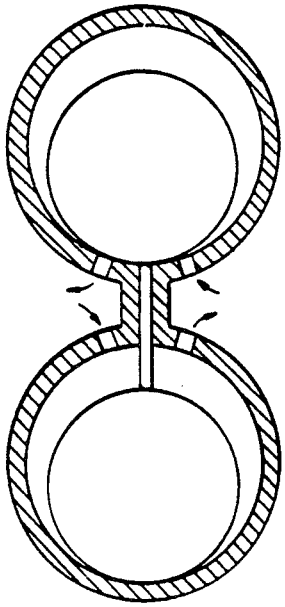
FIG. 3 PRIOR ART
FIGS. 1 to 3 illustrate various forms of compressor according to the prior art.
Figure 2:
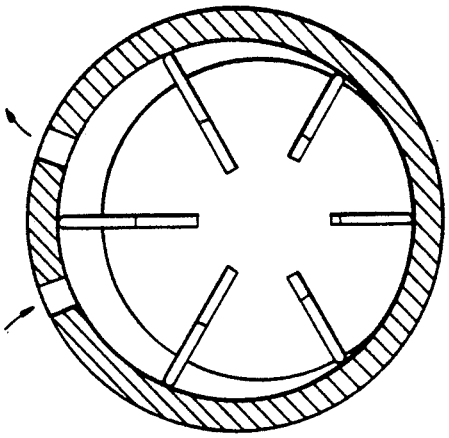
FIG. 2 PRIOR ART
Figure 1:
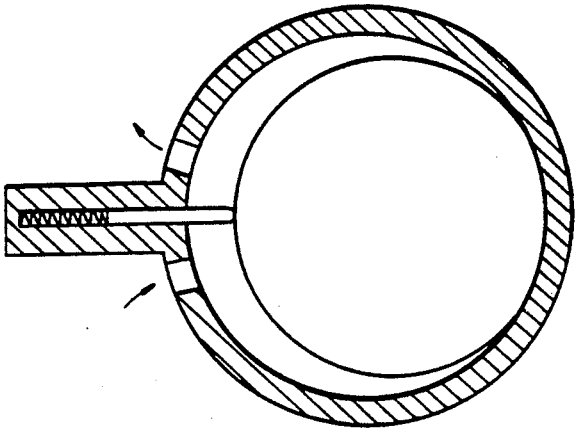
FIG. 1 PRIOR ART
Figure 4:
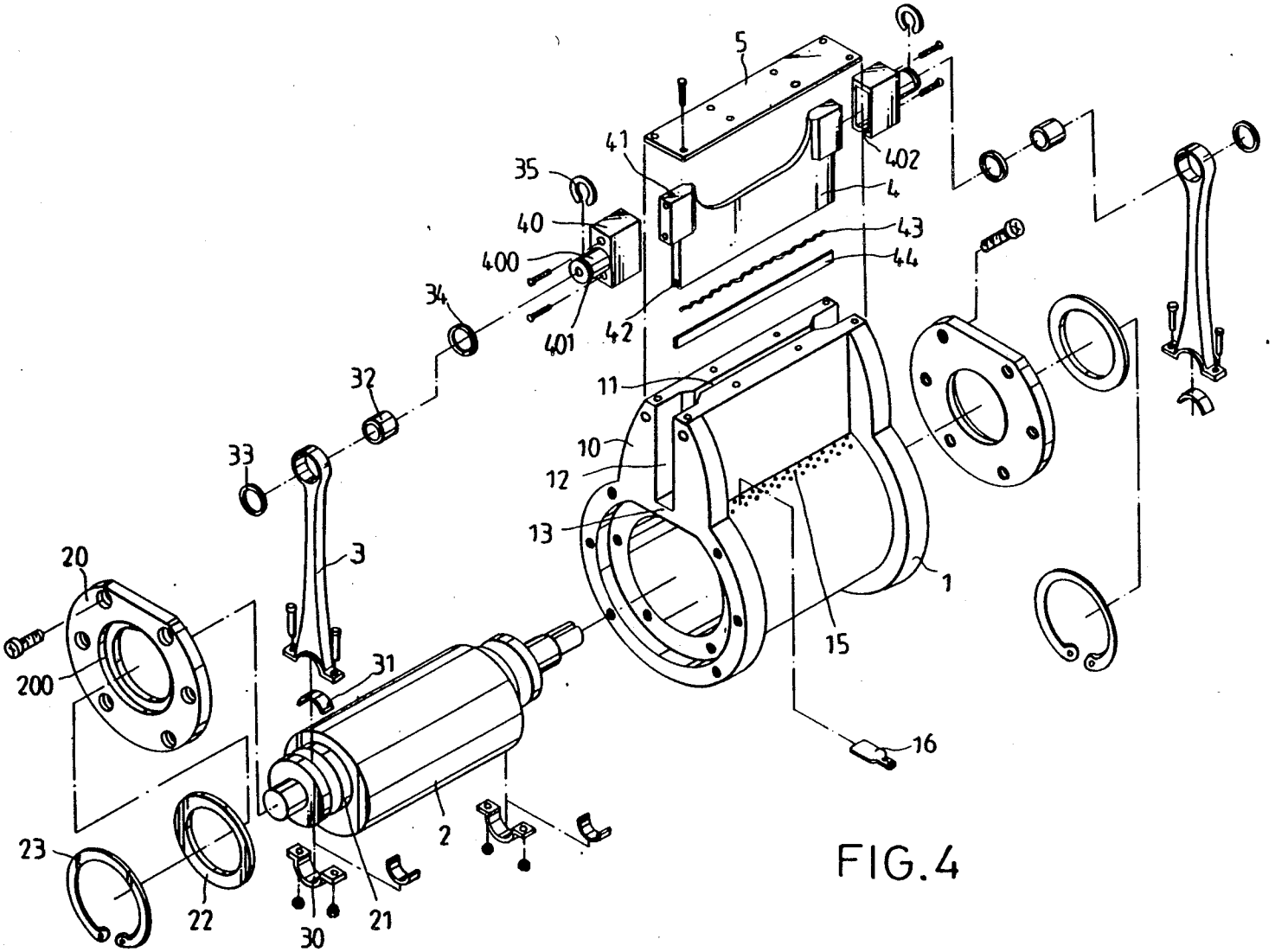
FIG. 4 is an exploded perspective view of the preferred embodiment of the present invention.
Figure 5:
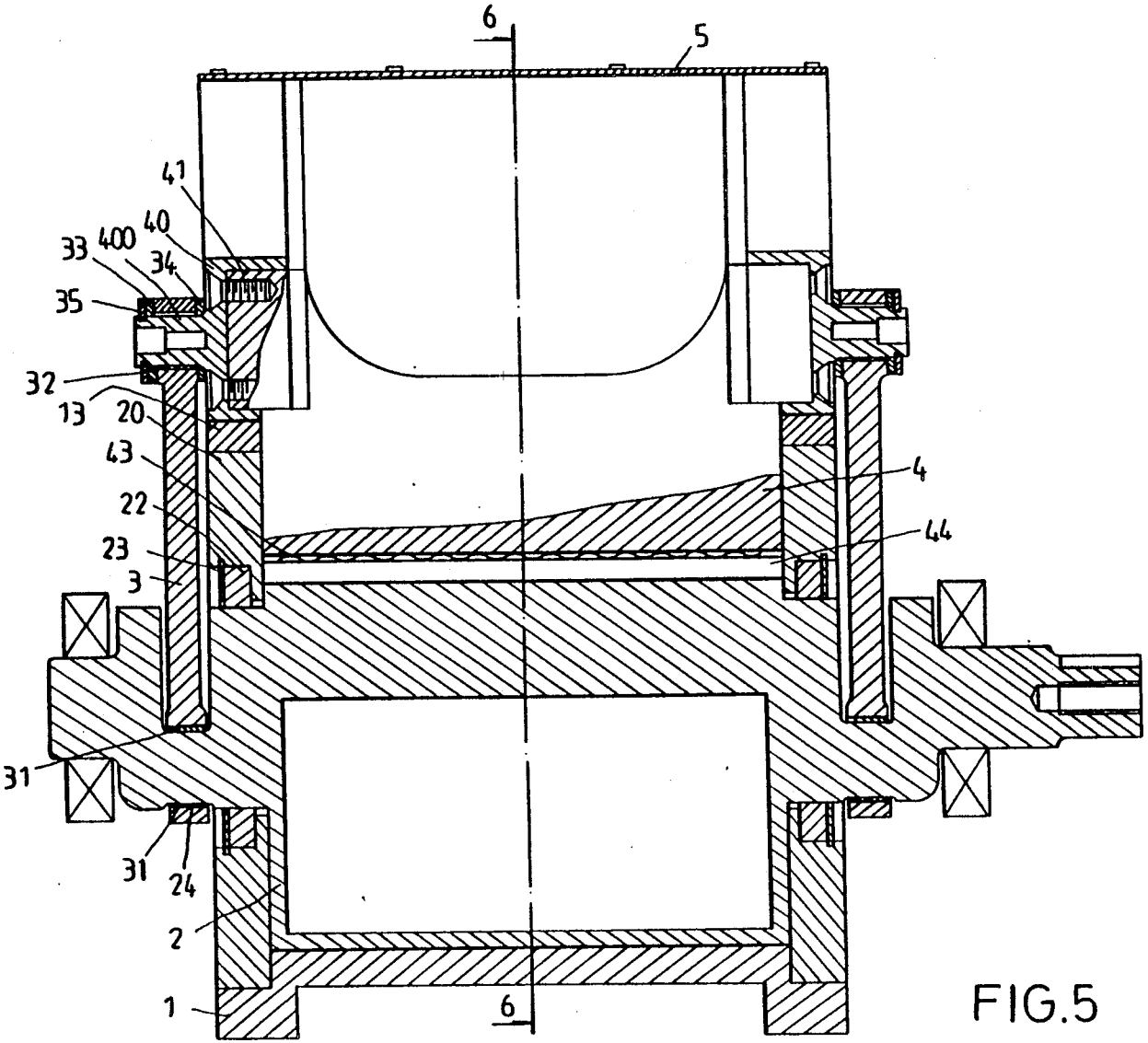
FIG. 5 is a sectional asembly view of the preferred embodiment of the present invention.
Figure 6:
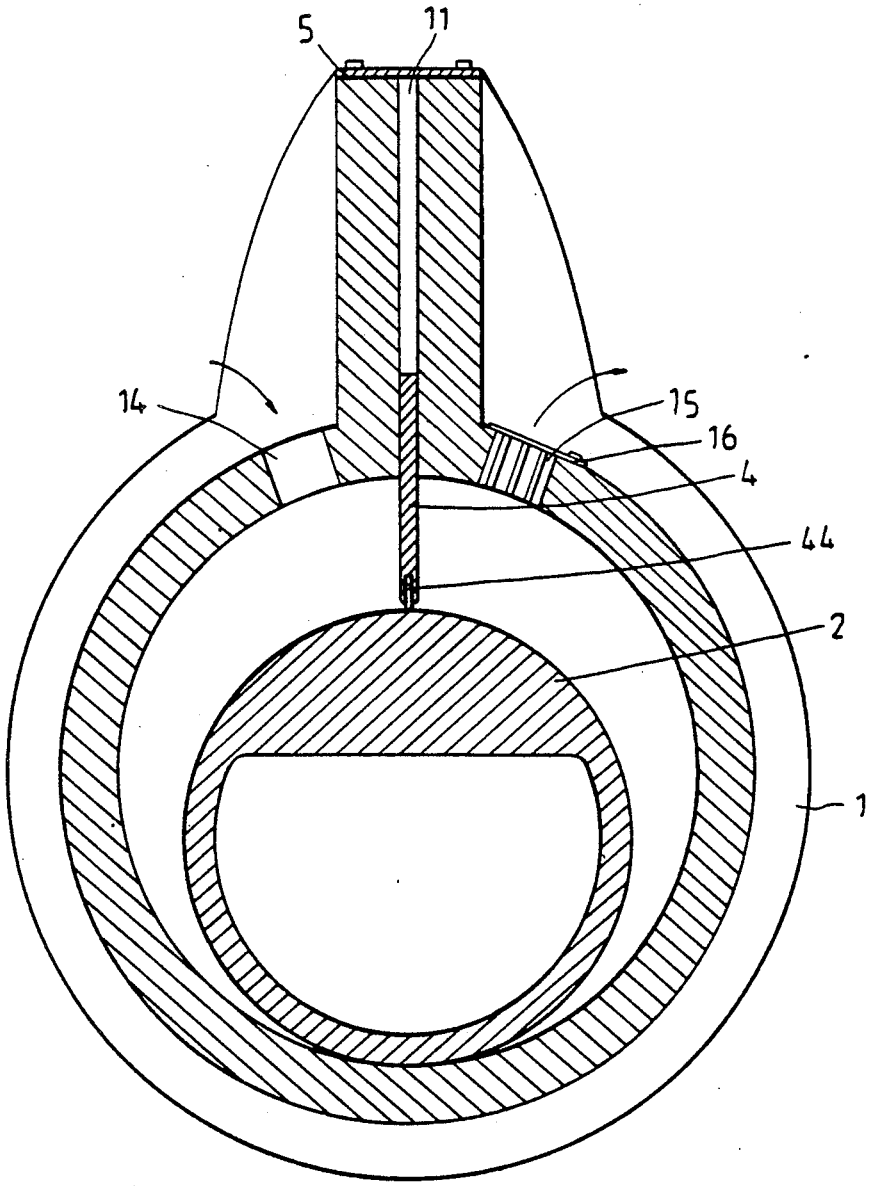
FIG. 6 is a sectional view taken on line 6—6 of FIG. 5.

Referring to FIGS. 4 and 5, a compressor constructed in accordance with the present invention is generally comprised of a housing 1, an eccentric wheel 2, a pair of links 3, and a blocking plate 4. A unitary block 10 is made on the housing 1 at the top, which is longitudinally divided into two parts by a narrow, elongated hole 11 which is disposed in communication with the inner chamber defined within the housing 1. The two opposite ends of the elongated hole 11 are respectively terminating in two guide slots 12 which are wider than the width of the elongated hole 11. At the bottom of each guide slot 12 there is formed a locating seat 13. An air intake port 14 and an exhaust port 15 (see FIG. 6) are respectively made on the housing 1 at two opposite sides of the block 10. Plate springs 16 are secured by screws to cover over the exhaust port 15 so that outside air is prohibited from entering the housing 1 through the exhaust port 15.

The eccentric wheel 2 is secured inside the housing 1 by two substantially ring-shaped cover plates 20 which are respectively fastened to the two opposite ends of the housing 1 by screws. There are provided two oil seals 22 respectively mounted on the housing 1 between the shaft 21 of the eccentric wheel 2 and the two ring-shaped cover plates 20. The cover plates 20 have each an annular groove 200 at the inside for mounting a retainer clip 23 which is used to retain the oil seals 22 in place. Two eccentric axles 24 are respectively formed at the two opposite ends of the revolving shaft 21 of the eccentric wheel 2 for mounting the links 3. The links 3 have each a semi-circular block 30 at one end and secured to either eccentric axle 24 by a combination bearing 31 and screws. The opposite end of each link 3 is an eyed end with a bearing 32 incorporated therein and secured to an axle 400 which extends from a connecting member 40 which is mounted on the blocking plate 4 at either side. Two gaskets 33 and 34 are attached to the eyed end of each link 4 on the axle 400 of each connecting member 40. After having been mounted on the axle of each connecting member 40, the gaskets 33 and 34, the bearing 32 and the eyed end of each link 3 are respectively retained in place by a retainer clip 35 which is fastened in an annular groove 401 made on the axle 400.

The blocking plate 4 has two opposite, raised blocks 41 at the top for mounting the connection member 40 each. The connecting member 40 has an elongated groove 402 at the bottom and designed in width according to the thickness of the blocking plate 4. Therefore, the block plate 4 can be engaged in the elongated groove 402 of the connecting member 40 when the connecting member 40 is mounted on the raised blocks 41. A channel 42 is made on the bottom end of the blocking plate 4 for fastening a spring 43 and an elongated resilient strip 44, permitting said elongated strip 44 to partly protruding beyond the bottom end of the blocking plate 4. After the blocking plate 4 is inserted in the elongated hole 11 of the unitary block 10, the elongated resilient strip 44 is stopped at the eccentric wheel 2, and the two connecting blocks 40 which are respectively mounted on the two raised blocks 41 of the blocking plate 4 are respectively disposed inside the two guide slots 12 of the unitary block 10. After all parts are connected together, a cover plate 5 is secured to the unitary block 10 of the housing 1 at the top, to firmly retain the blocking plate 4 in place.

In the aforesaid embodiment, the blocking plate 4 is not directly driven to move by the eccentric wheel 2. Therefore friction problem between the eccentric wheel and the blocking plate can be greatly improved. When the eccentric wheel 2 is carried to rotate by the revolving shaft 21, the eccentric axles 24 of the revolving shaft 21 simultaneously drive the links 3 to move back and forth. During reciprocating motion of the links 3, the blocking plate 4 is simultaneously driven by the links 3 to displace vertically in the elongated hole 11. Because the links 3 follow the rotary motion of the eccentric wheel 2 to move the blocking plate 4 up and down, the eccentric wheel 2 is not required to push the blocking plate 4 during its rotary motion, and therefore, friction between the eccentric wheel 2 and the blocking plate 4 is greatly reduced. Further, in order to eliminate poor contact or sticking problem between the blocking plate 4 and the eccentric wheel 2, a gap is provided between the bottom end of the blocking plate 4 and the eccentric wheel 2 for mounting the spring 43 and the elongated resilient strip 44, permitting the elongated resilient strip 44 to be constantly and flexibly disposed in contact with the eccentric wheel 2.

I claim:

1. A compressor of the type comprising a housing having an inner chamber for holding an eccentric wheel, a blocking plate movably connected to said eccentric wheel by a pair of links;

said housing having a unitary block covered with a cover plate for holding said blocking plate, said unitary block having an elongated hole disposed in communication with said inner chamber for receiving said blocking plate, said elongated hole having two opposite ends respectively terminating in a guide slot each, said guide slot being wider than the width of said elongated hole;

said eccentric wheel being confined inside said housing by two cover plates and driven to rotate by a revolving shaft, said revolving shaft being inserted through said cover plate for mounting said links and having two eccentric axles longitudinally aligned at two opposite ends thereof, said cover plates having a center hole for insertion therethrough of said revolving shaft, said center hole being sealed with oil seals retained in place by a retainer clip;

said links having each a semi-circular connecting end at the bottom and connected to either of said eccentric axles by a combination bearing, and an eyed end at the top and connected to said blocking plate;

said blocking plate having two opposite, raised blocks at the top for mounting a connecting member each permitting said connecting member to dispose in the guide slot at either end of said elongated hole, said connecting member having an axle at one end with a bearing fastened therein for holding said eyed end of said links, and an elongated channel at the bottom with a spring means and an elongated stip fastened therein permitting said elongated strip to press against said eccentric wheel.

* * * * *